United States Patent [19]

Hirose

[11] Patent Number: 4,537,142

[45] Date of Patent: Aug. 27, 1985

[54] SHUTTLE STOPPER FOR LOCK STITCH SEWING MACHINE

[75] Inventor: Tokuzo Hirose, Hyogo, Japan

[73] Assignee: Hirose Manufacturing Co., Ltd.,, Osaka, Japan

[21] Appl. No.: 534,624

[22] Filed: Sep. 22, 1983

[30] Foreign Application Priority Data

May 14, 1983 [JP] Japan ..... 58-84756

[51] Int. Cl.[3] ..... D05B 57/08; D05B 57/26

[52] U.S. Cl. ..... 112/231

[58] Field of Search ..... 112/181, 182, 183, 184, 112/228, 231

[56] References Cited

U.S. PATENT DOCUMENTS

| | | | |
|---|---|---|---|
| 2,990,794 | 7/1961 | Ketterer | 112/228 |
| 3,120,204 | 2/1964 | Ketterer | 112/228 |
| 3,146,744 | 9/1964 | Bradshaw | 112/232 |
| 4,142,475 | 3/1979 | Zocher | 112/181 |
| 4,363,282 | 12/1982 | Satake | 112/184 |

*Primary Examiner*—Wm. Carter Reynolds

*Attorney, Agent, or Firm*—Wenderoth, Lind & Ponack

[57] ABSTRACT

A stopper device for a lock stitch sewing machine includes a retaining member having a contacting face and which is moved in the downstream direction, with respect to the rotary running direction of the loop taker, when a needle thread loop passes between a contacting face of the bobbin case and such contacting face of the retaining member. This facilitates the passing of the needle thread loop. An arrangement returns the contacting face of the retaining member in the upstream direction.

4 Claims, 3 Drawing Figures

SHUTTLE STOPPER FOR LOCK STITCH SEWING MACHINE

BACKGROUND OF THE INVENTION

1. Field of the Invention

The present invention relates to a stopper for stopping the rotation of a bobbin case in a lock stitch sewing machine.

2. Description of the Prior Art

In a known vertical full rotation shuttle device, a bobbin case retaining member is fixed on a sewing machine body in order to arrest the rotation of a bobbin case. After a needle thread and a bobbin thread are tied to make a loop, the loop must pass through the retaining member and the contacting surface part of the bobbin case. The mutual contact pressure at this contacting position is unstable, and the tension of the needle thread fluctuates, which results in uneven thread tightening.

This problem conventionally has been solved by an opener mechanism, wherein when the needle thread passes through the contact position, the bobbin case is slightly moved angularly by a collision piece in a direction opposite to the direction of rotation of the loop taker, and a free space is formed for a moment in the contact position, so that the needle thread may pass through the space smoothly. In this method, however, since the bobbin case is angularly moved by the collision piece so that a free space may be produced between the retaining member and the bobbin case, noise due to the collision of the collision piece and the bobbin case, and of the retaining member and the bobin case cannot be avoided.

It is an object of the present invention to provide a stopper device for lock stitch sewing machine which is capable of passing the needle thread smoothly and quietly between the bobbin case and the retaining member.

SUMMARY OF THE INVENTION

In order to fulfill the objective mentioned above, in a stopper device for a lock stitch sewing machine according to this invention, a contacting face of a retaining member is moved in the downstream direction with respect to the rotary running direction of the loop taker from the bobbin case contacting face when the needle thread loop passes between the bobbin case contacting face and the contacting face of the retaining member, in order to facilitate the passing of the needle thread loop, and a drive means is provided to return the retaining member in the upstream direction.

According to this invention, when the needle thread loop passes between the bobbin case contacting face and the contacting face of the retaining member, the retaining member is moved in the downstream direction while the retaining member is kept in contact with the contacting face of the bobbin case with the needle thread held therebetween at a small pressure, so that the needle thread loop may pass smoothly without the generation of noise.

DESCRIPTION OF THE PREFERRED EMBODIMENTS

Figure 1:
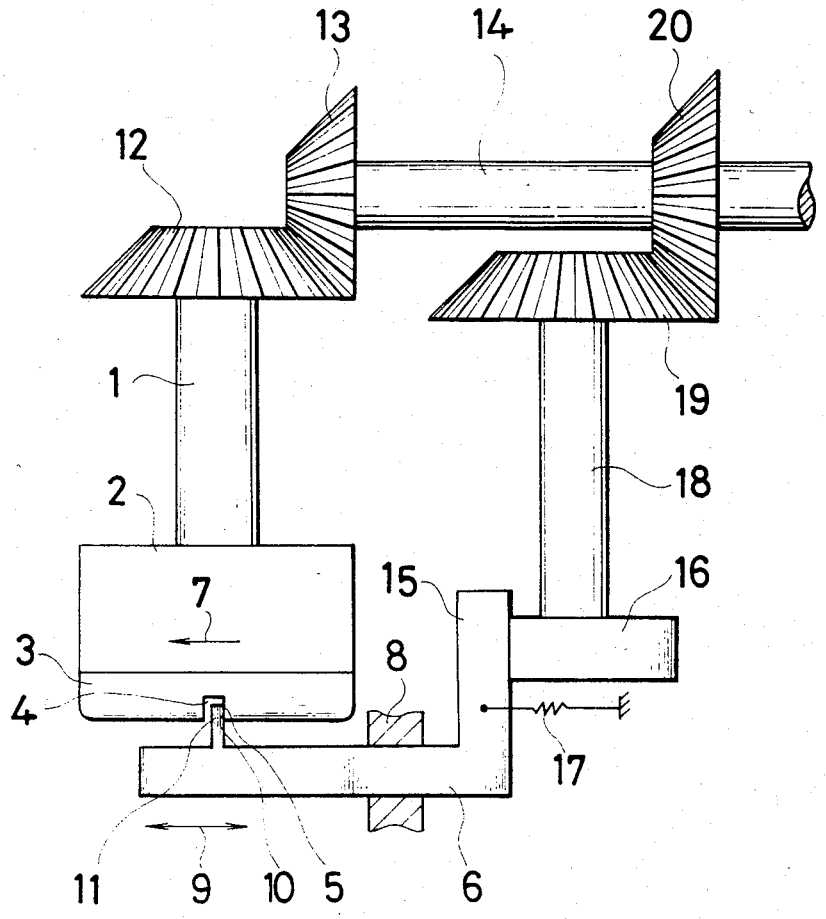
FIG. 1 is a plan view showing, in a simplified form, an embodiment of the present invention.

Referring now to the drawings, embodiments of the invention are described below.

FIG. 1 is a plan view showing a simplified form of one embodiment. A loop taker 2 is fixed on a rotary shaft 1 having a horizontal axis, and a bobbin case 3 is inserted in the loop taker 2. A bobbin case contacting face 5 is defined by a recess 4 formed in the outer end face of the bobbin case 3. A rotation retaining member 6 is supported by a support member 8 for movement in an upstream direction (to the right as viewed in FIG. 1) and a downstream direction (to the left as viewed in FIG. 1) with respect to the rotary running direction 7 of the loop taker 2, in relation to the contacting face 5. Thus, the retaining member 6 can be moved reciprocally in the directions of arrow 9. A protuberance 11 formed on the retaining member 6 extends into the recess 4, and a contacting face 10 of the retaining member is formed to be directed upstream with respect to the rotary running direction 7. When the bobbin case contact face 5 and the contacting face 10 are in mutual contact, the bobbin case 3 is held stationary regardless of the rotation of the loop taker 2. Drive shaft 1 is affixed to a bevel gear 12 which is engaged with another bevel gear 13. The bevel gear 13 is fixed on a rotary shaft 14 which is linked to a drive source.

An end of the retaining member 6 is a follower 15 which abuts against the cam surface of an eccentric cam 16. A spring 17 pushes the retaining member 6 so that the follower 15 will contact with the cam surface of the cam 16. The cam 16 is driven by a drive shaft 18. The drive shaft 18 has a bevel gear 19 mounted thereon, and this bevel gear 19 meshes with another bevel gear 20 fixed on the rotary shaft 14. The drive shaft 18 responsible for rotation of the cam 16 rotates at a speed equal to half the speed of the drive shaft 1 which drives the loop taker 2, due to the reduction ratio of bevel gears 12, 13, 19, 20.

When a needle thread loop passes between the bobbin case contacting face 5 and contacting face 10, the cam 16 moves the follower 15 and the retaining member 6 to the left as shown in FIG. 1, or downstream, with regard to the running direction 7, and then returns it to the right or upstream. At this time, the contacting face 10 of the retaining member 6 holds the needle thread in contact with the contacting face 5 while the needle thread is passing, and then slowly returns to the contacting face 5. Therefore, the thread of the needle thread loop may be passed smoothly without the emission of noise.

Figure 2:
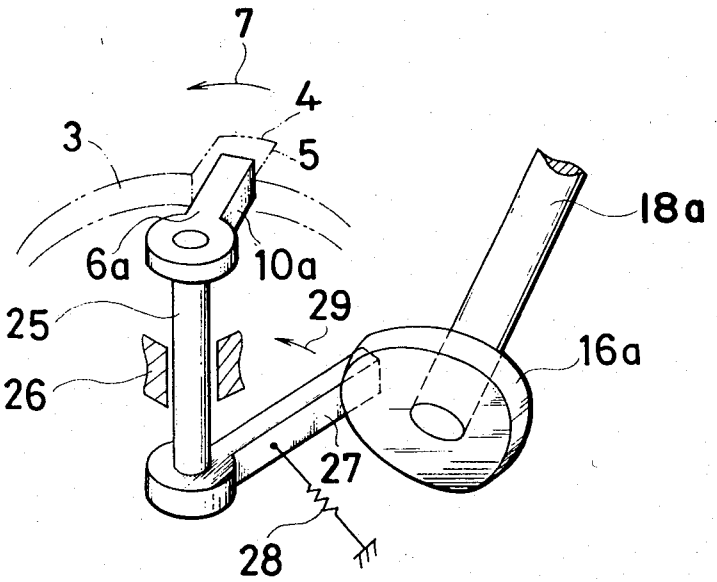
FIG. 2 is a perspective view of part of another embodiment of the invention.

FIG. 2 is a perspective view of another embodiment. In this example, which is similar to the previous embodiment, the same or similar reference numbers are employed for corresponding parts. The retaining member **6*a* is affixed to one end of a support shaft 25 which is held by a bearing 26. The axial line of the shaft 25 is vertical to the axial line of the drive shaft 1 (see FIG. 1). A follower 27 is affixed to the other end of the support shaft 25, and this follower 27 is abutted against an eccentric cam 16*a* by means of a spring 28. While the drive shaft 1 rotates two revolutions, the drive shaft 18 completes one revolution, and when the needle thread loop passes between the contacting face 5 and a contacting face 10*a*, the eccentric cam 16*a* moves the follower 27 in the direction of arrow 29. As a result, the support shaft 25 is rotated angularly. The retaining member 6*a* is rotated angularly in the same direction as the rotary running direction 7 of the loop taker. Therefore, the needle thread loop can smoothly pass between the contacting face 5 and contacting face 10***a*. After the passing of the needle thread loop, the follower 27 returns in a direction opposite to the direction of arrow 29, and the retaining member 6*a* returns to the original position.

Figure 3:
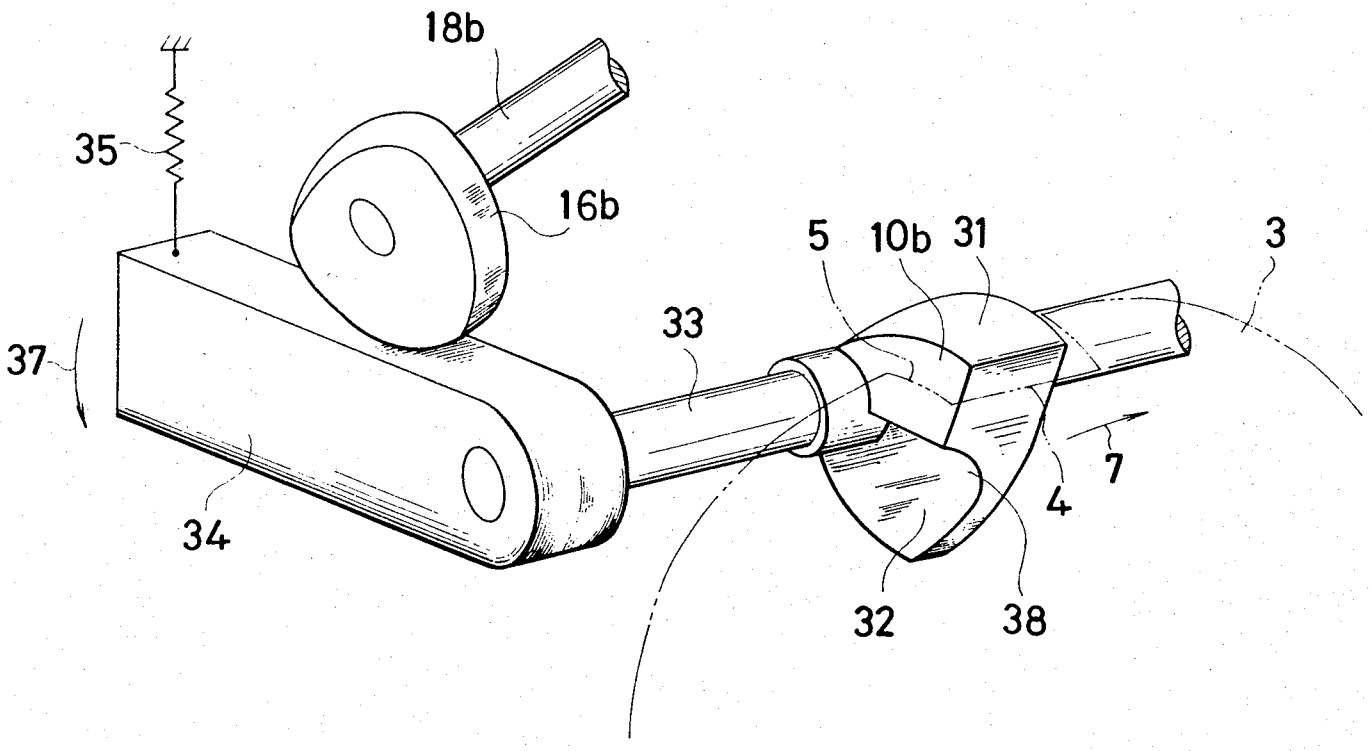
FIG. 3 is a perspective view of part of another embodiment according to the present invention.

FIG. 3 is a perspective view of part of another embodiment. The same or similar reference numbers are employed for corresponding parts. What is of note is that a retaining member 31 has a contacting face 10*b* which abuts against the contacting face 5 of the bobbin case 3. This retaining member 31 has a contacting face 32 which is concave in the downstream direction with regard to the rotary running direction 7 of the loop taker. Face 32 is joined to contacting face 10*b* by a curved communicating surface 38. A support shaft 33 is fixed to retaining member 31 and extends orthogonal to the axis of rotation of the loop taker (see FIG. 1). A follower 34 is fixed to support shaft 33. The follower 34 is urged by a spring 35 to abut against the cam surface of an eccentric cam 16*b*.

When the needle thread loop passes between the contacting face 5 and retaining member 31, the follower 34 is rotated angularly in the direction of arrow 37 by means of the eccentric cam 16*b*. As a result, the contacting face 5 abuts against the contacting face 32. Therefore, the needle thread loop may pass smoothly between the contacting face 5 and the contacting face 32 of the retaining member 31. After the passing of the needle thread loop, the follower 34 is rotated in a direction opposite to the direction of arrow 37, and the contacting face 5 moves from the contacting face 32, along communicating surface 38, to again abut the contacting face 10*b* of the retaining member, thereby returning to the original position. The communicating surface 38 smoothly connects the contacting face 10*b* and the contacting face 32, which permits smooth movement of the bobbin case 3 in the direction 7 and the reverse direction at the time of angular movement of the retaining member 31.

In the embodiment in FIG. 3, retaining member 31 is driven so as to be pivoted reciprocally, but it is also possible to provide another embodiment, by continously rotating a retaining member having a continuous contacting face in the peripheral direction contacting with the contacting face 5, forming the contacting plane 32 for slipping out the needle thread loop partly in the peripheral direction, and forming a contacting face 10*b* of the retaining member in the remaining part in the peripheral direction.

In another example, the present invention may be equally applied to horizontal full rotation shuttles or semi-rotation shuttles.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. In a lock stitch sewing machine of the type including a rotating loop taker, a bobbin case adjacent said loop taker, said bobbin case having therein a recess defining a first contacting face, and a stopper device for preventing rotation of said bobbin case with said loop taker, said stopper device including a retaining member extending into said recess and having a second contacting face contacting said first contacting face, the improvement of means for allowing a thread loop to pass between said first and second contacting faces without allowing substantial collision therebetween, said means comprising:

a third contacting face formed by a recess extending concavely into said retaining member in a downstream direction with respect to the direction of rotation of said loop taker, said third contacting face being joined to said second contacting face by a communicating surface curving smoothly from and third contacting face in an upstream direction;

means for moving said retaining member within said recess in said bobbin case from a first position, whereat said second contacting face abuts said first contacting face to prevent rotation of said bobbin case, to a second position, whereat said third contacting face confronts said first contacting surface, whereby a thread loop may be passed between said first contacting face and said retaining member; and means for restoring said retaining member from said second position thereof to said first position thereof after such passing of the thread loop.

2. The improvement claimed in claim 1, wherein said moving means comprises means for pivoting said retaining member about an axis extending orthogonal to the axis of rotation of said loop taker.

3. The improvement claimed in claim 2, wherein said pivoting means comprises a shaft having fixed thereto said retaining member and a cam follower, and an eccentric cam rotated in contact with said cam follower.

4. The improvement claimed in claim 3, wherein said restoring means comprises spring means for maintaining said cam follower in contact with said cam.

* * * * *